US008984930B2

(12) United States Patent
Worden et al.

(10) Patent No.: US 8,984,930 B2
(45) Date of Patent: Mar. 24, 2015

(54) SYSTEM AND METHOD FOR DIAGNOSING A RECIPROCATING COMPRESSOR

(75) Inventors: Bret Dwayne Worden, Erie, PA (US); Milan Karunaratne, Lawrence Park, PA (US)

(73) Assignee: General Electric Company, Schenectady, NY (US)

( * ) Notice: Subject to any disclaimer, the term of this patent is extended or adjusted under 35 U.S.C. 154(b) by 637 days.

(21) Appl. No.: 13/233,856

(22) Filed: Sep. 15, 2011

(65) Prior Publication Data

US 2013/0071260 A1 Mar. 21, 2013

(51) Int. Cl.
*F04B 51/00* (2006.01)
*F04B 27/24* (2006.01)
*F04B 49/06* (2006.01)

(52) U.S. Cl.
CPC ..... *F04B 51/00* (2013.01); *F04B 27/24* (2013.01); *F04B 49/065* (2013.01)
USPC ..... 73/47

(58) Field of Classification Search
CPC ..... G01M 3/2876
USPC ..... 73/40.5, 47
See application file for complete search history.

(56) References Cited

U.S. PATENT DOCUMENTS

| | | | | |
|---|---|---|---|---|
| 4,334,427 | A | 6/1982 | Armstrong | |
| 5,216,915 | A | 6/1993 | Sakamoto | |
| 5,471,400 | A | 11/1995 | Smalley et al. | |
| 5,711,272 | A | 1/1998 | Maegawa et al. | |
| 5,728,941 | A | 3/1998 | Yamamoto et al. | |
| 5,860,800 | A | 1/1999 | Kramer et al. | |
| 6,023,651 | A | 2/2000 | Nakayama et al. | |
| 6,510,731 | B2 | 1/2003 | Schricker et al. | |
| 6,658,346 | B2 | 12/2003 | Maegawa | |
| 6,968,268 | B2 | 11/2005 | Yamada et al. | |
| 7,133,766 | B2 | 11/2006 | Kokubo | |
| 7,153,106 | B2 * | 12/2006 | Cornwell | 417/213 |
| 7,197,916 | B2 | 4/2007 | Matsumoto et al. | |
| 7,620,522 | B2 | 11/2009 | Bredau et al. | |
| 7,761,223 | B2 | 7/2010 | Wang et al. | |
| 2002/0050271 | A1 | 5/2002 | Hasegawa et al. | |
| 2004/0148926 | A1 | 8/2004 | Morinaga et al. | |
| 2005/0204805 | A1 | 9/2005 | Wakahara et al. | |
| 2007/0253838 | A1 * | 11/2007 | Leiss | 417/298 |

(Continued)

FOREIGN PATENT DOCUMENTS

| | | | |
|---|---|---|---|
| EP | 0522849 | A1 | 7/1991 |
| EP | 1508736 | A1 | 2/2005 |

(Continued)

OTHER PUBLICATIONS

Search Report and Written Opinion from corresponding PCT Application No. PCT/US2012/053520 dated Dec. 17, 2012.

(Continued)

*Primary Examiner* — Hezron E Williams
*Assistant Examiner* — Mark A Shabman
(74) *Attorney, Agent, or Firm* — GE Global Patent Operation; John A. Kramer

(57) ABSTRACT

Methods and systems are provided for a compressor including a crankcase. A condition of the compressor may be diagnosed based on a valve leak condition of the compressor based on piston motion within the crankcase. Once a diagnosis is made, appropriate remedial action can be taken to minimize severity.

26 Claims, 5 Drawing Sheets

(56) References Cited

U.S. PATENT DOCUMENTS

| | | | | |
|---|---|---|---|---|
| 2008/0063551 | A1* | 3/2008 | Cornwell | 417/571 |
| 2008/0065355 | A1* | 3/2008 | Bredau et al. | 702/183 |
| 2009/0120174 | A1 | 5/2009 | Nadera et al. | |
| 2009/0229355 | A1 | 9/2009 | Shoda | |
| 2010/0162797 | A1 | 7/2010 | Summers et al. | |
| 2010/0211296 | A1 | 8/2010 | Saunders | |

FOREIGN PATENT DOCUMENTS

| | | | |
|---|---|---|---|
| WO | 2006056214 | A1 | 6/2006 |
| WO | 2008033677 | A2 | 3/2008 |

OTHER PUBLICATIONS

U.S. Appl. No. 13/047,200, filed Mar. 14, 2011.

* cited by examiner

SYSTEM AND METHOD FOR DIAGNOSING A RECIPROCATING COMPRESSOR

TECHNICAL FIELD

Embodiments of the subject matter disclosed herein relate to a system and a method for diagnosing a reciprocating compressor.

DISCUSSION OF ART

Compressor components may degrade during operation in various ways. For example, the effectiveness of valves may degrade causing leakage of charged air back into cylinders. Leaky valves can be caused by oil getting passed through the valves, recompressed, heating up to high temperatures, and carbonizing on the valves thereby causing the valves to lose efficiency and leak. The continuation of degradation of the valves results in higher temperatures, excessive component wear, and eventual valve failures which renders the compressor unable to provide charged air to a locomotive or other user of compressed air or other gas. Currently, reciprocating compressor prognostic and diagnostic methods center on vibration, acoustic, thermal or other technologies which require additional sensors beyond the basic output or reservoir pressure sensor.

BRIEF DESCRIPTION

In an embodiment, a method for a compressor is provided. The method includes diagnosing a valve leak condition of the compressor based on piston motion within the crankcase.

In an embodiment, a controller is used to determine a condition of a reciprocating compressor based on displacement of a piston during a time interval subsequent to a reservoir filled to a pressure level. Displacement of the piston is indicative of a valve leak within the reciprocating compressor.

In an embodiment, a reciprocating compressor includes at least one piston, each piston is coupled to a crankshaft and disposed within a respective cylinder. A reservoir stores charged air output by the cylinders. An exhaust valve allows air compressed by each piston to transmit from the respective cylinder to the reservoir. An intake valve allows air to enter each respective cylinder prior to displacement of the piston. A sensor measures at least one metric during a time period that is indicative of a leak condition of each exhaust valve at the final compressor stage.

In an embodiment, a method is employed for a reciprocating compressor operationally connected to a reservoir. The reservoir is filled to meet or exceed a pressure level. A valve disposed between the reservoir and one or more cylinders is closed, wherein each cylinder houses a piston, the piston is not in a bottom dead center position. The compressor is closed with respect to atmosphere to maintain a charged air condition within the compressor. If piston motion is detected, a signal is output to indicate that the valve has a leakage condition.

This brief description is provided to introduce a selection of concepts in a simplified form that are further described herein. This brief description is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

BRIEF DESCRIPTION OF THE DRAWINGS

Reference is made to the accompanying drawings in which particular embodiments and further benefits of the invention are illustrated as described in more detail in the description below, in which.

DETAILED DESCRIPTION

Embodiments of the subject matter disclosed herein relate to systems and methods for diagnosing a compressor. The compressor may be included in a vehicle, such as a locomotive system. Other suitable types of vehicles may include on-highway vehicles, off-highway vehicles, mining equipment, and marine vessels. Other embodiments may be used for stationary compressors. These vehicles may include a compressor with components that degrade with use. Such condition can be detected to identify a faulty condition and initiate preemptive remedial action in response to prevent overall compressor failure.

The subject embodiments are intended to detect leaks in the valves of an air compressor, such as a reciprocating compressor, by evaluating the crank position or speed of the compressor (high pressure exhaust valve in particular). Once the compressor has charged the reservoir to an acceptable limit, the compressor shuts off. This technology focuses on the speed signal (e.g., crank position) response of the air compressor after the compressor has charged the system and shut-off. If there is a significant leak in the valve (assuming piston not at bottom dead center), the charged air in the reservoir will bleed back through an exhaust valve to force the high pressure piston head to displace downward thus causing a response in the speed signal (or crank position) of the compressor. The exemplary systems and methods can be used as an early identification system for valve wear and failure that eventually leads to compressor failure.

The subject systems and methods can also be used to diagnose and prognose problems in an air compressor prior to total compressor failure, which can also result in a road failure. If onset of valve failure (leaks) can be detected in the system, proper corrective action can be provided to stop progression of failure and identify issues in the system. In this manner, customers can realize a cost savings by prognosing the problem in initial stages of failure before the valve leaks lead to other component failures and ultimate compressor failures and locomotive shutdowns. Secondary damage avoidance is also a benefit in that other engine components (pistons, liners, etc.) can be saved if leaks are detected in a early stage.

Figure 1:
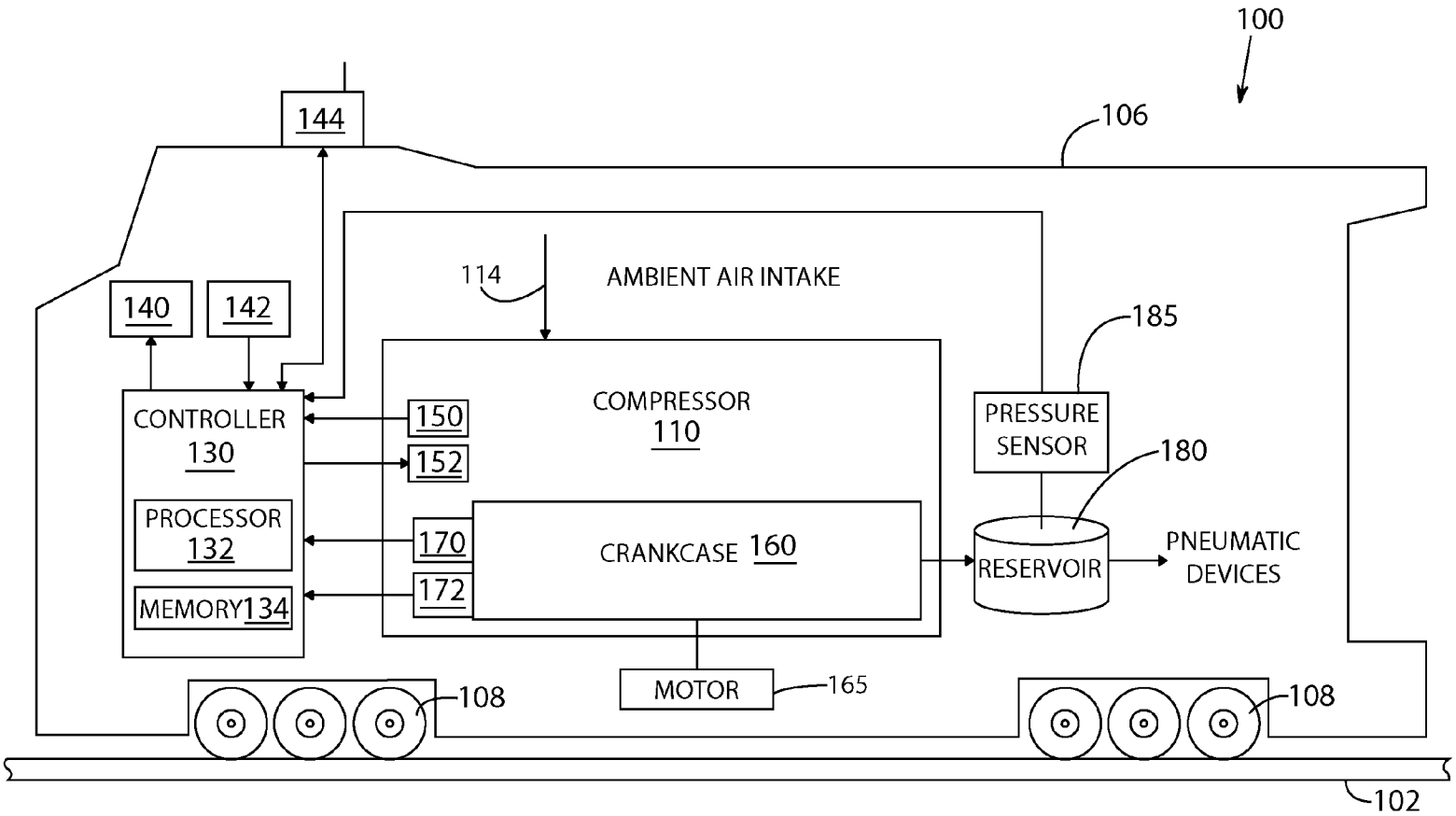
FIG. 1 shows an example embodiment of a vehicle including a compressor having a crankcase.

FIG. 1 shows a block diagram of an example embodiment of a vehicle system 100 (e.g., a locomotive system), herein depicted as a rail vehicle 106 configured to run on a rail 102 via a plurality of wheels 108. As depicted, the rail vehicle 106 includes a compressor system with a compressor 110. In an embodiment, the compressor is a reciprocating compressor that delivers air at high pressure. For this purpose, the compressor can compress air received via the ambient air intake 114 in a multi-stage process to generate charged air. In an example, ambient air is compressed in a first stage to a first pressure level and delivered to a second stage, which further compresses the air to a second pressure level that is higher than the first. The charged air at the second pressure level can subsequently be stored in a reservoir.

The compressor 110 includes a crankcase 160. Crankcase 160 is an enclosure for a crankshaft (not shown in FIG. 1) connected to cylinders (not shown in FIG. 1) of the compressor. A motor 165 is employed to rotate the crankshaft to drive the pistons within the cylinders. The crankshaft may be lubricated by compressor oil that is pumped by an oil pump (not shown) and sprayed onto the crankshaft. The crankshaft in turn can be mechanically coupled to a plurality of pistons via respective connecting rods. The pistons are drawn down and pushed up as the crankshaft is rotated to generate and output charged air in one or more stages.

The rail vehicle 106 further includes a controller 130 to control various components related to the vehicle system 100. In one example, controller 130 includes a computer control system. In one embodiment, the computer control system includes a processor, such as processor 132. The controller 130 may include multiple compressor control units (ECU) and the control system may be distributed among each of the ECUs. The controller 130 further includes computer readable storage media, such as memory 134, including instructions for enabling on-board monitoring and control of rail vehicle operation. Memory 134 may include volatile and non-volatile memory storage.

The controller may oversee control and management of the vehicle system 100. The controller may receive signals from a variety of compressor sensors 150 to determine operating parameters and operating conditions, and correspondingly adjust various compressor actuators 152 to control operation of the rail vehicle 106. For example, the controller may receive signals from various sensors including compressor speed, compressor load, boost pressure, exhaust pressure, ambient pressure, exhaust temperature, etc. As another example, the controller may receive a signal from a crankcase pressure sensor 170 that indicates a pressure of crankcase 160. As another example, the controller may receive a signal from a crankshaft position sensor 172 that indicates a position of the crankshaft. Correspondingly, the controller may control the vehicle system by sending commands to various components such as traction motors, alternator, cylinder valves, throttle, etc. Signals from sensors 150, 170, and 172 may be bundled together into one or more wiring harnesses to reduce space in vehicle system 100 devoted to wiring and to protect the signal wires from abrasion and vibration.

The controller may include onboard electronic diagnostics for recording operational characteristics of the compressor. Operational characteristics may include measurements from sensors 150, 170, and 172, for example. Such operational characteristics may be stored in a database in memory 134. In one embodiment, current operational characteristics may be compared to past operational characteristics to determine trends of compressor performance.

The controller may include onboard electronic diagnostics for identifying and recording potential degradation and failures of components of vehicle system 100. For example, when a potentially degraded component is identified, a diagnostic code may be stored in memory 134. In one embodiment, a unique diagnostic code may correspond to each type of degradation that may be identified by the controller. For example, a first diagnostic code may indicate a nonfunctional exhaust valve of a cylinder, a second diagnostic code may indicate a nonfunctional intake valve of a cylinder, a third diagnostic code may indicate inappropriate compression action from a piston, etc. The controller can modify output of charged air from the compressor 110 based on various parameters including the condition of associated charged air systems (e.g., within adjacent locomotive engines), environmental conditions, overall pneumatic supply demand, etc.

The controller may be further linked to display 140, such as a diagnostic interface display, providing a user interface to the locomotive operating crew and a maintenance crew. The controller may control the compressor, in response to operator input via user input controls 142, by sending a command to correspondingly adjust various compressor actuators 152. Non-limiting examples of user input controls 142 may include a throttle control, a braking control, a keyboard, and a power switch. Further, operational characteristics of the compressor, such as diagnostic codes corresponding to degraded components, may be reported via display 140 to the operator and/or the maintenance crew.

The vehicle system may include a communications system 144 linked to the controller. In one embodiment, communications system 144 may include a radio and an antenna for transmitting and receiving voice and data messages. For example, data communications may be between vehicle system and a control center of a railroad, another locomotive, a satellite, and/or a wayside device, such as a railroad switch. For example, the controller may estimate geographic coordinates of vehicle system using signals from a GPS receiver. As another example, the controller may transmit operational characteristics of the compressor to the control center via a message transmitted from communications system 144. In one embodiment, a message may be transmitted to the command center by communications system 144 when a degraded component of the compressor is detected and the vehicle system may be scheduled for maintenance.

An example of a degraded component may be an exhaust valve of a compressor cylinder. Proper operation of the compressor relies upon a functional intake valve and exhaust valve associated with each cylinder. The intake valve opens to draw in air as a piston is pulled down to bottom dead center via rotation of the crankshaft (not shown). At bottom dead center the intake valve closes thereby sealing the cylinder. As the crankshaft continues to rotate, the piston is pushed up from bottom dead center to compress air contained within the cylinder to a desired pressure level before the exhaust valve opens thereby allowing the charged air to escape from the cylinder and into a reservoir 180. This process is repeated until the reservoir is filled with charged air at a pressure level as determined by a sensor 185. The reservoir is coupled to one or more pneumatic systems and/or devices to facilitate operation thereof.

After the reservoir is filled, the air system between the reservoir input and the compressor is closed and one or more pistons within the compressor are monitored. In an embodiment, a piston within a high pressure stage cylinder is monitored to determine if the piston displaces within a time period subsequent to reservoir filling. If such displacement is detected, it can be assumed that an exhaust valve is faulty as it allowed charged air to bleed back thereby forcing the piston to move down toward the bottom of the cylinder. Displacement of the piston can be accomplished by detecting the crank position or speed of the compressor using one or more compressor sensors 150.

In an embodiment, the compressor is a two stroke compressor. In a two stroke compressor, the intake and exhaust functions are separated as the piston approaches bottom dead center at the end of the intake stroke and as the piston moves away from bottom dead center at the beginning of the compression stroke. The intake stroke draws air into the cylinder as the piston is pulled down by the crankshaft as it is rotated by the motor. As the crankshaft continues to rotate, the piston compresses the air in the cylinder as the piston moves toward top dead center during a compression stroke. Thus, the compressor, e.g. crankshaft 250, may rotate once during one two stroke cycle.

Figure 2:
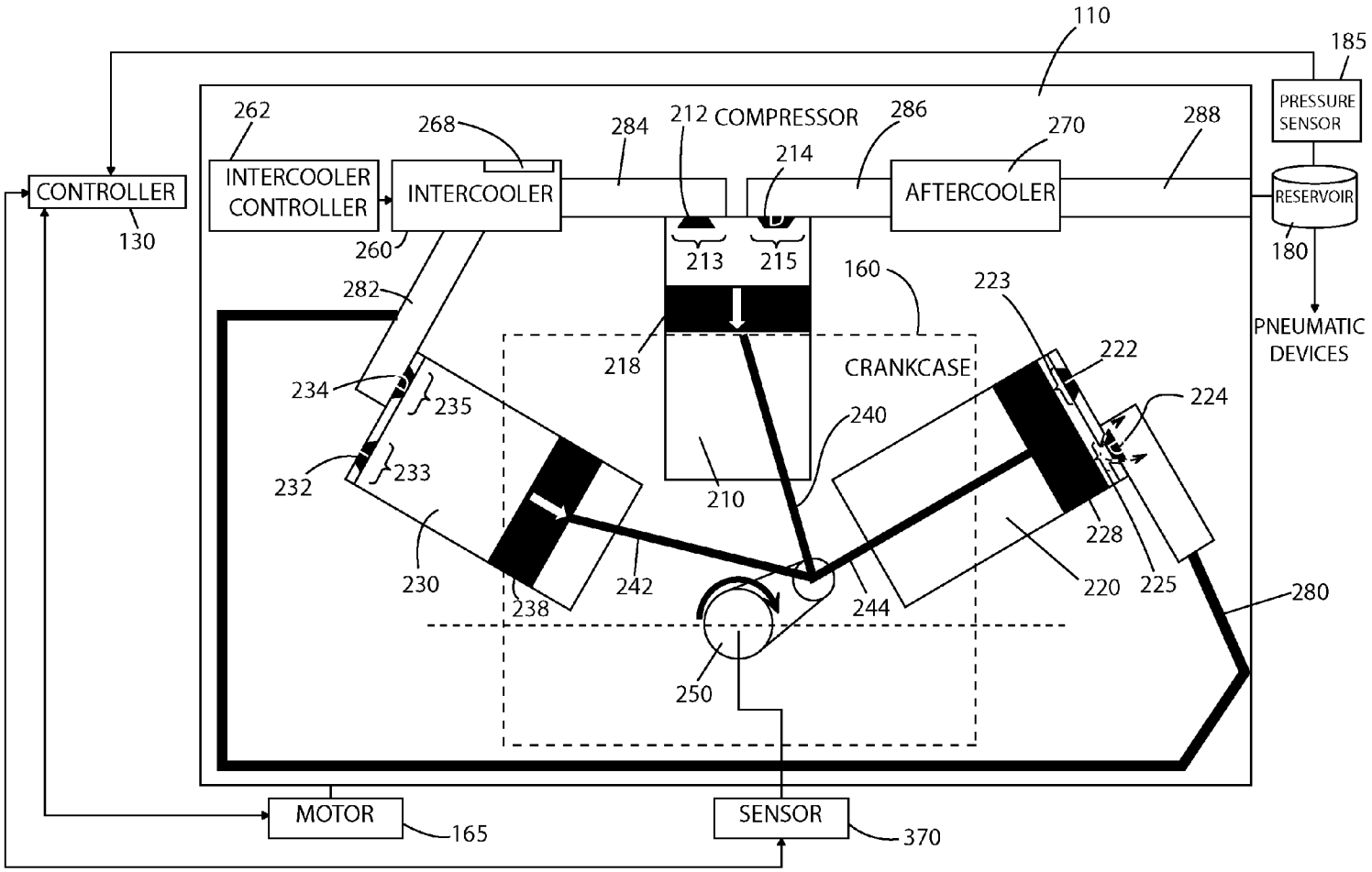
FIG. 2 shows a detailed view of the compressor including high and low pressure cylinders.

FIG. 2 illustrates a detailed view of the compressor 110 set forth in FIG. 1 above. The compressor includes three cylinders 210, 220, 230. Each cylinder contains a piston 218, 228, 238 that is coupled to a crankshaft 250 via connecting rods 240, 242, 244. The crankshaft 250 is driven by the motor 165 to cyclically pull the respective pistons down to bottom dead center and push the pistons to top dead center to output charged air, which is delivered to the reservoir 180 via air lines 280, 282, 284, 286. In this embodiment, the compressor is divided into two stages: a low pressure stage and a high pressure stage to produce charged air in a stepwise approach. The low pressure stage compresses air to a first pressure level which is further compressed by the high pressure stage to a second pressure level. In this example, the low pressure stage includes cylinders 220, 230 and the high pressure stage includes cylinder 210.

In operation, air from the ambient air intake 114 is first drawn into the low pressure cylinders via intake valves 222, 232, which open and close within ports 223, 233. The ambient air is drawn in as the low pressure cylinders are pulled to bottom dead center wherein the intake valves 222, 232 separate from ports 223, 233 to allow air to enter each cylinder 220, 230. Once the pistons reach bottom dead center, the intake valves 222 and 232 close the ports 223, 233 to contain air within each cylinder. Subsequently, pistons 228, 238 are pushed toward top dead center, thereby compressing ambient air initially drawn into the cylinders. Once the cylinders have compressed the ambient air to a first pressure level, exhaust valves 224, 234 within ports 225, 235 are opened to release the low pressure air into low pressure lines 280, 282.

The low pressure air is routed to an intercooler 260 to remove the heat of compression through a substantially constant pressure cooling process. A decrease in the temperature of the air allows a greater density to be drawn into the high pressure stage to facilitate a greater efficiency to provide a desired pressure level while utilizing a minimum amount of resources. The rate, volume, temperature, etc. of air exhausted from the intercooler is determined by an intercooler controller 262. In an embodiment, the intercooler controller employs a thermostatic control through mechanical means such as via thermal expansion of metal.

Low pressure air exhausted from the intercooler 260 into low pressure air line 284 is subsequently drawn into the high pressure cylinder 210. More particularly, as piston 218 is pulled toward bottom dead center, the intake valve 212 opens thereby allowing the low pressure air to be drawn into the cylinder 210 via intake port 213. Once the piston 218 reaches bottom dead center, the intake valve 212 closes to seal the low pressure air within the cylinder 210. The piston is then pushed upward thereby compressing the low pressure air into high pressure air. As compression increases the exhaust valve 214 is opened to allow the high pressure air to exhaust into high pressure line 286 via exhaust port 215. An aftercooler 270 cools the high pressure air to facilitate a greater density to be delivered to the reservoir 180 via air line 288.

The above process is repeated cyclically as the crankshaft 250 rotates to continuously provide high pressure air to the reservoir 180, which is monitored by the pressure sensor 185. Once the reservoir 180 reaches a particular pressure level (e.g., 140 psi), the pressure sensor 185 sends an output to the controller 130 to unload the compressor by actuating the unloader valve 268, and turn off the motor 165. In addition, the unloader valve is closed when the compressor is at rest to seal the air lines and cylinders to maintain a charged air pressure level throughout the compressor 110 for a period of time. During this period, certain valves within the compressor 110 may be evaluated to insure that they are in proper working condition.

In one embodiment, the exhaust valve 214 is evaluated to determine if it can maintain a closed position while under pressure. A faulty valve condition can be detected by monitoring the motion of the crankshaft 250 via a sensor 370, which identifies displacement and/or speed of the crankshaft 250. In this example, the crankshaft 250 does not normally move during the time period following filling of the reservoir as the motor is turned off. Thus, any movement detected by the sensor 370 can be caused by high pressure air from the air line 286 leaking into the cylinder 210 as a result of a exhaust valve 214 improperly becoming unseated from the port 215.

As a result of the faulty condition of the exhaust valve 214, air leaking into the cylinder 210 displaces the piston 218 toward a bottom dead center position. As the piston is coupled to the crankshaft via connecting rod 240, movement of the piston 218 also turns the crankshaft 250. As a faulty valve condition is manifested as a displaced piston, monitoring of piston displacement can be initiated subsequent each time the reservoir 180 is filled to a particular pressure level. A plurality of readings can be taken over the time period to insure that a faulty condition is identified even if one or more readings occur when the piston is in a bottom dead center position at the beginning of the time period. In this manner, it is not necessary to determine the starting position of the piston 218 within the cylinder 210.

Figure 3:
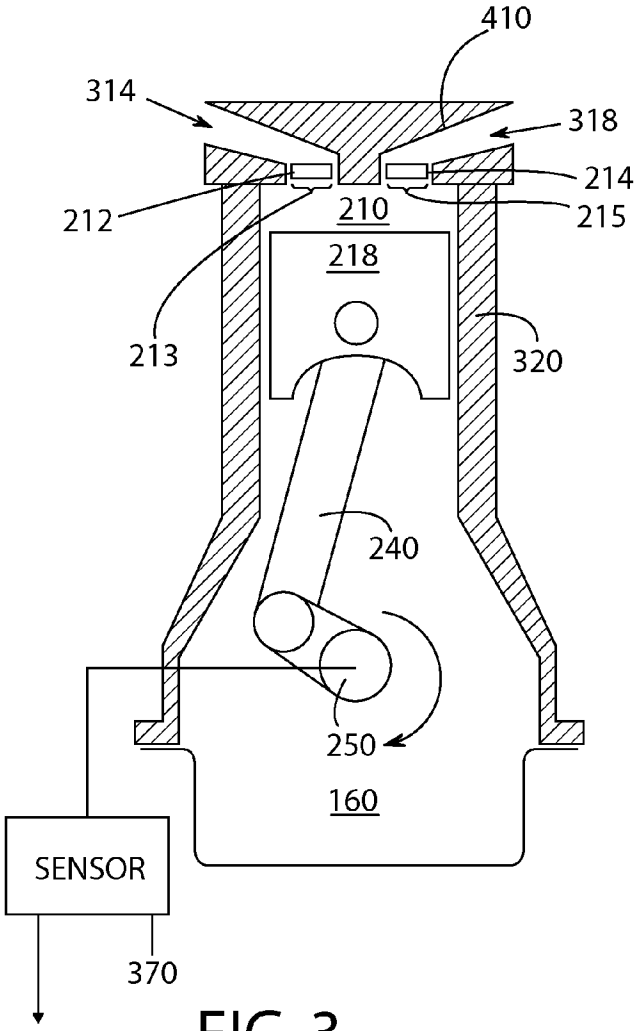
FIG. 3 shows an example embodiment of a cylinder of the compressor during the compression stroke.

FIG. 3 illustrates an example embodiment of cylinder 210 of the compressor during a compression stroke. In this embodiment, cylinder 210 includes cylinder wall 320 and a volume for drawing in and compressing air. Piston 218 may be coupled to a crankshaft 250 by a connecting rod 240 so that the reciprocating motion of piston 218 may be translated into rotational motion of crankshaft 250. Crankshaft 250 and connecting rod 240 are enclosed within crankcase 160. Piston 218 reciprocates back and forth within cylinder 210 from a top dead center position to a bottom dead center position. The top dead center position corresponds to the position of piston 218 that is closest to an intake valve 312 and an exhaust valve 316. The bottom dead center position corresponds to the position of piston 218 that is farthest from intake valve 312 and exhaust valve 316. In one embodiment, intake valve 312 may be opened to allow air into cylinder 210 from intake passage 314. Exhaust valve 216 may be opened to allow charged air 410 to exit cylinder 210 through exhaust passage 318. Charged air pushed out of the cylinder via the exhaust valve 216 is directed to the reservoir for storage and subsequent use.

Figure 4:
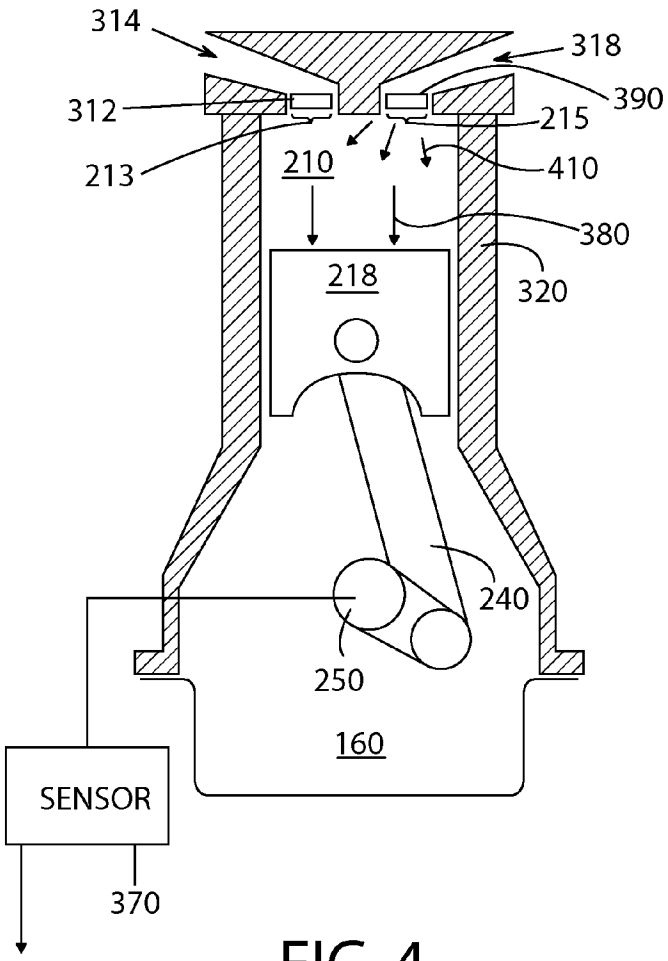
FIG. 4 shows an example embodiment of a cylinder of the compressor during the intake stroke.

FIG. 4 illustrates the piston 218 during a time period subsequent to filling the reservoir. In this embodiment, a leaky valve 390 is employed which allows charged air 410 from the reservoir to bleed back into the cylinder 210. The valve 390 can become faulty based on degradation of one or more valve components as the compressor is used. For example, walls of intake port 213 or exhaust port 215 may become scuffed, gouged, pitted, and/or scraped which may increase the gap between intake valve 212 and exhaust valve 214 and their respective ports 213, 215. Thus, valve leakage may increase in a degraded port. In another example, intake valve 212 or exhaust valve 214 may degrade as the compressor is used. Springs, washers, o-rings, gaskets, and other valve components may shrink, potentially allowing charged air to move past the valve as a seal is not properly made. As another example, one or more valve components may warp, fracture, or be damaged in a manner that may increase air leakage. Thus, leakage may increase when one or more valve components and their respective ports are degraded.

If charged air 410 bleeds back into the cylinder, displacement of the piston 218 can occur from downward force 380 applied to the top of the piston. To identify such a condition, sensor 370 can be employed to determine if the piston 218 has been displaced. In this example, the sensor 370 is coupled to the crankshaft to indirectly monitor the location of the piston during a time period subsequent to reservoir filling. Displacement of the piston 218 causes movement of the crankshaft 350 as these components are mechanically coupled. In one embodiment, the sensor 370 detects speed of the crankshaft 250 using Hall effect or other measurement technology. In another embodiment, the sensor 370 detects position (e.g., rotational displacement) of the crankshaft by detecting the location of one or more features of the crankshaft 250 and/or one or more components coupled thereto. If the sensor 370 identifies a condition that indicates movement of the crankshaft subsequent to filling the reservoir, it can be inferred that the downward force 380, caused by a leaky exhaust valve, has been applied to the piston 218.

Figure 5:
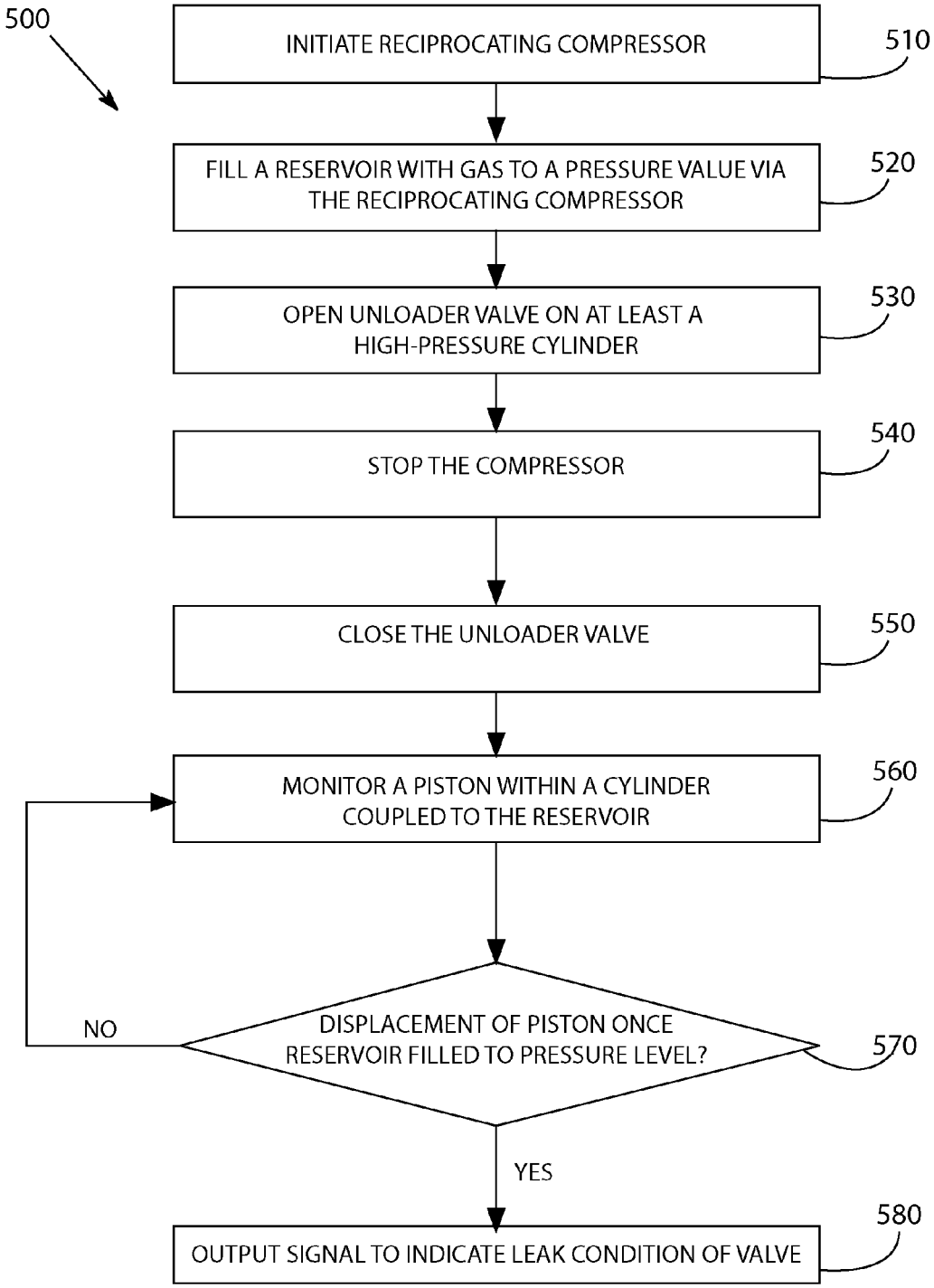
FIG. 5 shows an example embodiment of a method for diagnosing a condition of the compressor.

FIG. 5 illustrates a methodology 500 that can be implemented by the controller 130 to identify a leak condition of a valve within a compressor. At reference numeral 510, operation of a reciprocating compressor is initiated to generate a desired quantity of air at a particular pressure level, which can be utilized by one or more pneumatic devices for operation thereof. At 520, a reservoir is filled with charged air to a pressure value via the reciprocating compressor. The pressure value can be selected based upon the number and type of devices dependent thereupon the compressor output, in one example. At 530, an unloader valve is opened on at least a high pressure cylinder, such as cylinder 210 described herein. In an embodiment, the unloader valve for several low pressure cylinders are closed as well as the high pressure cylinder. At 540, the compressor is stopped and at 550, the one or more unloader valves are closed to maintain charged air within the compressor for valve evaluation.

Once the reservoir is filled, at 560 a piston within a cylinder coupled to the reservoir is monitored. A loader valve can be closed during this time period to maintain a charged air level within the compressor. In this manner, functionality of a valve containing the charged air can be properly tested. At 570, a determination is made whether the piston is displaced once the reservoir is filled with air. Displacement of the piston can be determined by rotational movement of a crankshaft or other member mechanically coupled to the piston. If such displacement is detected, a signal is output to indicate that a leak condition of the valve exists. If no displacement is detected (e.g., no crankshaft movement), the method returns to step 560 to continue monitoring the valve condition. In this manner, a bottom dead center placement of the piston can be overcome by obtaining a plurality of measurements over the time period as the piston will not be exclusively in a bottom dead center position. If piston displacement is detected during the time period following reservoir filling, a signal is output at 580 to indicate a leak condition of the valve. In this manner, corrective measures can be taken to address the valve leak before any serious consequence (e.g., compressor failure) results. Corrective measures can include disconnecting power to the compressor, reducing output of the compressor, switching from the compressor to another the source of charged air In an embodiment, the piston location is determined immediately after reservoir filling is complete. Such location is important to insure that the sensor 370 is providing an accurate reading. For example, if the piston is located at bottom dead center, the application of force caused by the charged air 310 will not cause downward displacement of the piston as there is no room for further movement. Thus, a measurement of no displacement may not be an accurate indication that the valve 216 is in good working order. To overcome this measurement deficiency, the sensor 370 may take measurements of the crankshaft 250 over a time period and multiple compressor charge cycles to determine if a leaky valve condition exists. In this manner, it can be assumed that the piston 218 is not in the bottom dead center position every time the reservoir has been filled. Accordingly, displacement of the piston 218 can be identified during one or more alternate cycles to notify a user of such condition. If such a condition exists an audio alarm, a visual alarm, a text message, an email, an instant message, a phone call or other means can be employed to notify appropriate personnel in response to the signal output.

In addition, valve leakage data may be recorded. In one embodiment, valve leakage data may be stored in a database including historical compressor data. For example, the database may be stored in memory 134 of controller 130. As another example, the database may be stored at a site remote from rail vehicle 106. For example, historical compressor data may be encapsulated in a message and transmitted with communications system 144. In this manner, a command center may monitor the health of the compressor in real-time. For example, the command center may perform steps, such as steps 520, 530, 540, and 550 to diagnose the condition of the compressor using the compressor data transmitted with communications system 144. For example, the command center may receive compressor data including cylinder pressure data from rail vehicle 106, displacement of one or more pistons, and/or movement of the crankshaft to diagnose potential degradation of the compressor. Further, the command center may schedule maintenance and deploy healthy locomotives and maintenance crews in a manner to optimize capital investment. Historical compressor data may be further used to evaluate the health of the compressor before and after compressor service, compressor modifications, and compressor component change-outs.

Figure 6:
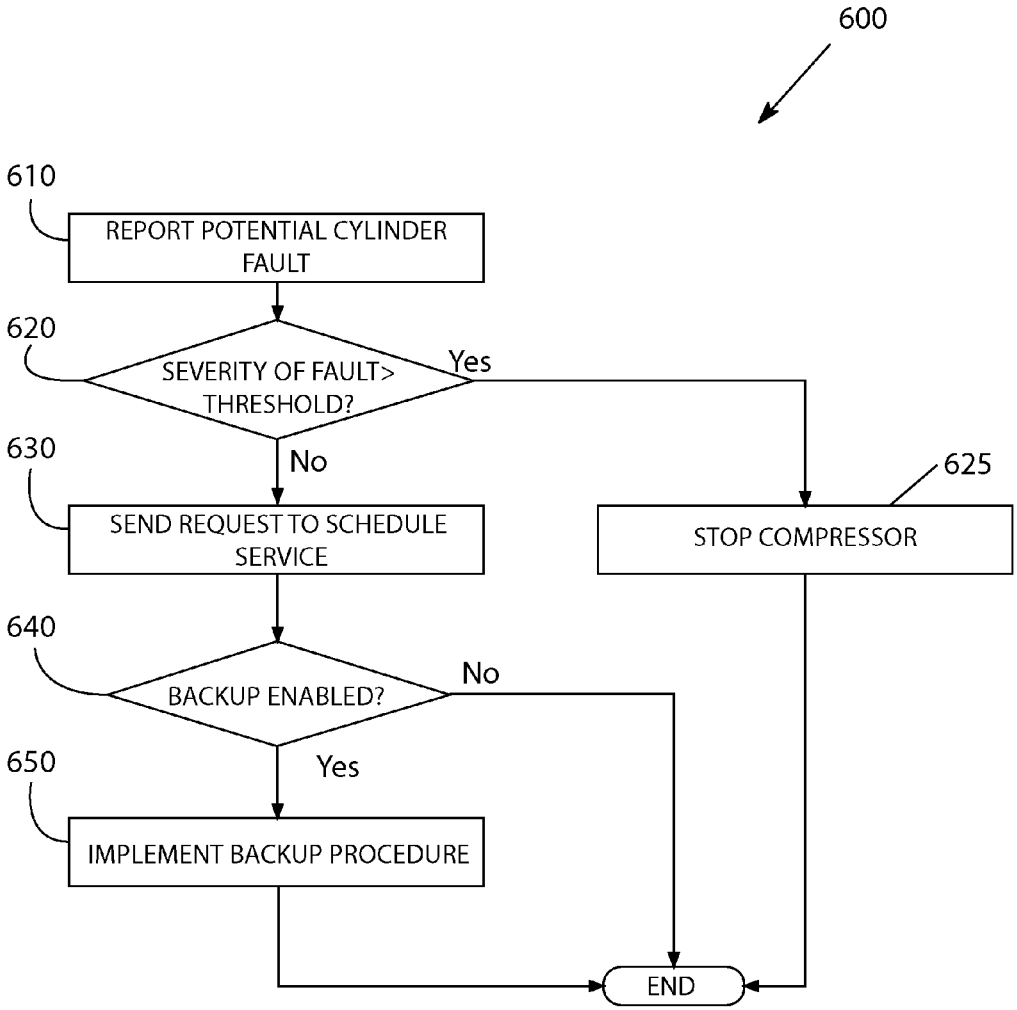
FIG. 6 shows an example embodiment of a method for responding to a condition of the compressor.

If a faulty valve condition exists, further diagnostics and response may be performed as illustrated with an example methodology 600 shown in FIG. 6. At 610, potential faulty valve condition can be reported to notify appropriate personnel. In an embodiment, reporting is initiated with signal output to indicate a leak condition of the valve exists, from step 550 in FIG. 5. The report may be via display 140 or a message transmitted with communications system 144, for example. Once notified, the operator may adjust operation of rail vehicle 106 to reduce the potential of further degradation of the compressor.

In one embodiment, a message indicating a potential fault may be transmitted with communications system 144 to a command center. Further, the severity of the potential fault may be reported. For example, diagnosing a fault based on rotational displacement of the crankshaft 250 pressure may allow a fault to be detected earlier than when the fault is diagnosed with other means. Thus, the compressor may continue to operate when a potential fault is diagnosed in the early stages of degradation. In contrast, it may be desirable to stop the compressor or schedule prompt maintenance if a potential fault is diagnosed as severe. In one embodiment, the severity of a potential fault may be determined according to a difference between a threshold value and the magnitude of rotational displacement and/or speed of the crankshaft. In this manner the cost of secondary damage to air compressor by early and accurate detection can be avoided.

At 620, the severity of the potential fault may be compared to a threshold value. For example, it may be more desirable to switch off the compressor than to have a degraded cylinder fail in a manner that may cause additional damage to the compressor. In one embodiment, a threshold value may be determined that indicates continued operation of the compressor may be undesirable because the potential fault is severe. For example, the potential fault may be judged as severe if the crankshaft is moved beyond a particular angle of rotation. The compressor may be stopped, at 625, if the severity of the potential fault exceeds the threshold value. Otherwise, method 600 may continue at 630.

At 630, a request to schedule service may be sent, such as by a message sent via communications system 144, for example. Further, by sending the potential fault condition and the severity of the potential fault, down-time of rail vehicle 106 may be reduced. For example, service may be deferred on rail vehicle 106 when the potential fault is of low severity. Down-time may be further reduced by derating power of the compressor, such as by adjusting a compressor operating parameter based on the diagnosed condition.

At 640, it may be determined if backup of the compressor is enabled. In an example, backup systems can be evaluated to determine if adequate substitute resources exist to replace the compromised compressor. In some instances, a pre-ordered list of backup systems is used to prioritize backup systems. If a backup is enabled, a backup procedure is implemented at 650. If no backup is enabled, the method 600 ends. At 650, the backup procedure can include stopping the compressor and receiving charged air from another source. In one example, the other source is a compressor that is disposed on an adjacent locomotive engine. In another example, the other source is a redundant compressor on the same locomotive that is used for this purpose. The backup procedure can be designed to minimize negative system-wide consequences to operation of the locomotive. This is especially true for systems deemed to be critical such as braking systems, which rely on charged air to operate. In such instances, a backup system is necessary to prevent shut down of the locomotive.

In one embodiment, a test kit may be used for identifying faulty compressor valve condition and diagnosing a condition of the valve based on the movement of the crankshaft. For example, a test kit may include a controller that is operable to communicate with one or more sensors coupled to crankcase and operable to sense crankshaft speed and/or rotation. The controller may be further operable to transform signals from the one or more sensors into a an output that represents a faulty valve condition and severity thereof. For example, severity of a faulty valve can be correlated with the amount of rotation of the crankshaft as more air is allowed into the cylinder as the severity of the leakage condition increases.

In an embodiment, a method is employed for a reciprocating compressor to detect a leak condition of a valve via recognition of displacement of an associated piston. Such displacement is caused by air flow through the valve during a time period in which no piston motion is expected. A reservoir is filled with air to a pressure value, wherein the reservoir is coupled to a cylinder that includes piston within a closed air circuit, wherein an exhaust valve is disposed between the reservoir and the cylinder. A determination is made as to whether the piston is displaced once the reservoir is filled to the pressure value. A signal is output to indicate the leak condition of the valve within the closed air circuit if the piston is displaced. Displacement of the associated piston is detected via a sensor that monitors a crankshaft position within the reciprocating compressor.

As described herein, no piston motion is expected during periods of time in the compressor cycle when one or more conditions are satisfied. Conditions can include whether the reservoir has been filled to a pressure level; a time period has been met that relates to particular heat, work, current draw, etc. of the motor, which can be associated with deleterious consequences; a pre-programmed cycle time has expired; or other metrics that facilitate efficient motor operation to produce charged air for storage in the reservoir. Alternatively or in addition, even when a condition has been satisfied, one or more additional evaluations can be employed including whether power is delivered from the motor to the compressor and whether the speed, displacement, and/or pressure sensors output a value that is significant relative to a threshold. For example, a value output from a speed or displacement sensor may be below a threshold whereas a pressure sensor may be above a threshold to qualify as a no motion state.

In an embodiment, a method is employed for a reciprocating compressor to detect a leak condition of a valve via recognition of displacement of an associated piston. Such displacement is caused by air flow through the valve during a time period in which no piston motion is expected. An unloader valve is closed during the time period to facilitate a pressurized state within the reciprocating compressor, the unloader valve forces open an intake valve to one or more cylinders in the air compressor.

In an embodiment, a method is employed for a reciprocating compressor to detect a leak condition of a valve via recognition of displacement of an associated piston. Such displacement is caused by air flow through the valve during a time period in which no piston motion is expected. An unloader valve is opened during the time period to facilitate an unpressurized state within the reciprocating compressor, the unloader valve forces open an intake valve to one or more cylinders in the air compressor.

In an embodiment, a method is employed for a reciprocating compressor to detect a leak condition of a valve via recognition of displacement of an associated piston. Such displacement is caused by air flow through the valve during a time period in which no piston motion is expected. The reciprocating compressor supplies charged air within a locomotive.

In an embodiment, a method is employed for a reciprocating compressor to detect a leak condition of a valve via recognition of displacement of an associated piston. Such displacement is caused by air flow through the valve during a time period in which no piston motion is expected. The time period begins once a reservoir coupled to the reciprocating compressor meets or exceeds a pressure level value.

In an embodiment, a method is employed for a reciprocating compressor to detect a leak condition of a valve via recognition of displacement of an associated piston. Such displacement is caused by air flow through the valve during a time period in which no piston motion is expected. A signal is output in response to recognition of displacement of the associated piston. Power to the reciprocating compressor is disconnected in response to the signal output.

In an embodiment, a method is employed for a reciprocating compressor to detect a leak condition of a valve via recognition of displacement of an associated piston. Such displacement is caused by air flow through the valve during a time period in which no piston motion is expected. A signal is output in response to recognition of displacement of the associated piston. Personnel are notified via one or more of an audio alarm, a visual alarm, a text message, an email, an instant message, and a phone call in response to the signal output.

In an embodiment, a method is employed for a reciprocating compressor to detect a leak condition of a valve via recognition of displacement of an associated piston. Such displacement is caused by air flow through the valve during a time period in which no piston motion is expected. A signal is output in response to recognition of displacement of the associated piston. The flow of charged air to the reciprocating compressor is engaged from one or more other sources in response to the signal output.

In an embodiment, a method is employed for a reciprocating compressor to detect a leak condition of a valve via recognition of displacement of an associated piston. Such displacement is caused by air flow through the valve during a time period in which no piston motion is expected. A signal is output that is commensurate with a severity level of the leak condition, wherein the severity level is determined according to displacement of the associated piston.

In an embodiment, a test kit includes a controller that is operable to determine a condition of a reciprocating compressor based on displacement of a piston during a time interval subsequent to a reservoir filled to a pressure level. Displacement of the piston is indicative of a valve leak within the reciprocating compressor. One or more sensors detect parameters associated with air pressure subsequent to filling the reservoir to predetermined level, wherein the controller is operable with the one or more sensors to sample the parameter measurements.

In an embodiment, a test kit includes a controller that is operable to determine a condition of a reciprocating compressor based on displacement of a piston during a time interval subsequent to a reservoir filled to a pressure level. Displacement of the piston is indicative of a valve leak within the reciprocating compressor. The controller is further operable to transform crankshaft speed into a pressure parameter within the crankshaft.

In an embodiment, a test kit includes a controller that is operable to determine a condition of a reciprocating compressor based on displacement of a piston during a time interval subsequent to a reservoir filled to a pressure level. Displacement of the piston is indicative of a valve leak within the reciprocating compressor. An unloader valve is closed while the reservoir is filled and during a subsequent time interval thereafter.

In an embodiment, a reciprocating compressor includes a plurality of pistons, each piston is coupled to a crankshaft and disposed within a respective cylinder. A reservoir stores charged air output by the cylinders. An exhaust valve allows air compressed by each piston to transmit from the respective cylinder to the reservoir. An intake valve allows air to enter each respective cylinder prior to displacement of the piston. A sensor measures at least one metric during a time period that is indicative of a leak condition of each exhaust valve. Each of the plurality of pistons are not in a bottom dead center position at the beginning of the time period.

In an embodiment, a reciprocating compressor includes a plurality of pistons, each piston is coupled to a crankshaft and disposed within a respective cylinder. A reservoir stores charged air output by the cylinders. An exhaust valve allows air compressed by each piston to transmit from the respective cylinder to the reservoir. An intake valve allows air to enter each respective cylinder prior to displacement of the piston. A sensor measures at least one metric during a time period that is indicative of a leak condition of each exhaust valve. A sensor measures a position of the crankshaft, wherein the position of the crankshaft indicates a leak condition for the valve.

In an embodiment, a method is employed for a reciprocating compressor operationally connected to a reservoir. The reservoir is filled to meet or exceed a pressure level. A valve disposed between the reservoir and one or more cylinders is closed, wherein each cylinder houses a piston, the piston is not in a bottom dead center position. If piston motion is detected, a signal is output to indicate that the valve has a leakage condition.

This written description uses examples to disclose the invention, including the best mode, and also to enable one of ordinary skill in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that are not different from the literal language of the claims, or if they include equivalent structural elements with insubstantial differences from the literal language of the claims.

The invention claimed is:

1. A method for a reciprocating compressor, comprising:

detecting a leak condition of a valve via recognition of displacement of an associated piston, which is caused by air flow through the valve during a time period in which no piston motion is expected; and closing an unloader valve during the time period to facilitate a pressurized state within the reciprocating compressor, the unloader valve forces open an intake valve to one or more cylinders in the reciprocating compressor.

2. The method of claim 1, further comprising:

filling a reservoir with charged air to a pressure value, wherein the reservoir is coupled to a cylinder that includes a piston within a closed air circuit;

disposing an exhaust valve between the reservoir and the cylinder;

determining if the piston is displaced once the reservoir is filled to the pressure value; and outputting a signal that indicates the leak condition of the valve within the closed air circuit if the piston is displaced.

3. The method of claim 2, further comprising detecting displacement of the associated piston via a sensor that monitors a crankshaft position within the reciprocating compressor.

4. The method of claim 1, wherein the reciprocating compressor supplies charged air within a locomotive.

5. The method of claim 1, wherein the time period begins once a reservoir coupled to the reciprocating compressor meets or exceeds a pressure level value.

6. The method of claim 1, further comprising outputting a signal in response to recognition of displacement of the associated piston.

7. The method of claim 6, further comprising disconnecting power to the reciprocating compressor in response to the signal output.

8. The method of claim 6, further comprising notifying personnel via one or more of an audio alarm, a visual alarm, a text message, an email, an instant message, or a phone call in response to the signal output.

9. The method of claim 6, further comprising engaging the flow of charged air to the reciprocating compressor from one or more other sources in response to the signal output.

10. The method of claim 1, further comprising outputting a signal that is commensurate with a severity level of the leak condition, wherein the severity level is determined according to displacement of the associated piston.

11. The method for a reciprocating compressor of claim 1, wherein detecting a leak condition of a valve via recognition of displacement of an associated piston comprises:

detecting the leak condition of the valve via recognition of displacement of the associated piston toward a bottom dead center position.

12. The method for a reciprocating compressor of claim 11, further comprising:

prior to detecting the leak condition, stopping the piston within the cylinder such that the piston is not in a bottom dead center position.

13. A method for a reciprocating compressor, comprising:

detecting a leak condition of a valve via recognition of displacement of an associated piston, which is caused by air flow through the valve during a time period in which no piston motion is expected; and opening an unloader valve during the time period to facilitate an unpressurized state for at least one cylinder within the reciprocating compressor, while a closed volume is still maintained in a high pressure cylinder.

14. The method of claim 13, further comprising:

filling a reservoir with charged air to a pressure value, wherein the reservoir is coupled to a cylinder that includes a piston within a closed air circuit;

disposing an exhaust valve between the reservoir and the cylinder;

determining if the piston is displaced once the reservoir is filled to the pressure value; and outputting a signal that indicates the leak condition of the valve within the closed air circuit if the piston is displaced.

15. The method of claim 14, further comprising detecting displacement of the associated piston via a sensor that monitors a crankshaft position within the reciprocating compressor.

16. The method of claim 13, wherein the reciprocating compressor supplies charged air within a locomotive.

17. The method of claim 13, wherein the time period begins once a reservoir coupled to the reciprocating compressor meets or exceeds a pressure level value.

18. The method of claim 13, further comprising outputting a signal in response to recognition of displacement of the associated piston.

19. The method of claim 18, further comprising disconnecting power to the reciprocating compressor in response to the signal output.

20. The method of claim 18, further comprising notifying personnel via one or more of an audio alarm, a visual alarm, a text message, an email, an instant message, or a phone call in response to the signal output.

21. The method of claim 18, further comprising engaging the flow of charged air to the reciprocating compressor from one or more other sources in response to the signal output.

22. The method of claim 13, further comprising outputting a signal that is commensurate with a severity level of the leak condition, wherein the severity level is determined according to displacement of the associated piston.

23. The method for a reciprocating compressor of claim 13, wherein detecting a leak condition of a valve via recognition of displacement of an associated piston comprises:

detecting the leak condition of the valve via recognition of displacement of the associated piston toward a bottom dead center position.

24. The method for a reciprocating compressor of claim 23, further comprising:

prior to detecting the leak condition, stopping the piston within the cylinder such that the piston is not in a bottom dead center position.

25. A reciprocating compressor comprising:

a piston coupled to a crankshaft and disposed within a cylinder;

a reservoir configured to store charged air output from the cylinder;

an exhaust valve that allows air compressed by the piston to transmit from the cylinder to the reservoir;

an intake valve that allows air to enter the cylinder; and a sensor configured to detect a leak condition of the exhaust valve via recognition of displacement of the piston, which is caused by air flow through the exhaust valve during a time period in which no piston motion is expected, responsive to an unloader valve being closed during the time period to facilitate a pressurized state within the reciprocating compressor, such that the unloader valve forces open the intake valve to the cylinder in the reciprocating compressor.

26. A reciprocating compressor comprising:

a piston coupled to a crankshaft and disposed within a first cylinder;

a reservoir configured to store charged air output from the first cylinder;

an exhaust valve that allows air compressed by the piston to transmit from the first cylinder to the reservoir;

an intake valve that allows air to enter the first cylinder; and a sensor configured to detect a leak condition of the exhaust valve via recognition of displacement of the piston, which is caused by air flow through the exhaust valve during a time period in which no piston motion is expected, and responsive to an unloader valve being opened during the time period to facilitate an unpressurized state for a second cylinder within the reciprocating compressor, while a closed volume is still maintained in the first cylinder.

* * * * *